United States Patent [19]

Willans

[11] 4,447,308

[45] May 8, 1984

[54] ELECTRODE BRUSHING APPARATUS

[75] Inventor: Robert D. H. Willans, Trail, Canada

[73] Assignee: Cominco Ltd., Vancouver, Canada

[21] Appl. No.: 495,842

[22] Filed: May 18, 1983

[30] Foreign Application Priority Data

Jun. 17, 1982 [CA] Canada ..... 405419

[51] Int. Cl.[3] ..... C25D 17/10; C25D 21/00; A47L 25/00

[52] U.S. Cl. ..... 204/279; 204/280; 204/281; 204/242; 204/198; 15/77

[58] Field of Search ..... 204/280, 281, 198, 279, 204/242; 15/77; 156/584

[56] References Cited

U.S. PATENT DOCUMENTS

| | | | |
|---|---|---|---|
| 2,343,532 | 3/1944 | Buckley | 15/77 |
| 2,439,305 | 4/1948 | Johnson | 15/77 |
| 3,501,795 | 3/1970 | Jasberg | 15/77 |
| 3,847,779 | 11/1974 | Sekine et al. | 204/198 |
| 4,138,755 | 2/1979 | Hashimoto et al. | 15/77 |
| 4,148,108 | 4/1979 | Kamata et al. | 15/77 |

*Primary Examiner*—T. Tung
*Assistant Examiner*—Nathan S. Thane
*Attorney, Agent, or Firm*—Arne I. Fors; Robert F. Delbridge

[57] ABSTRACT

A method and an apparatus for brushing electrodes such as cathodes used in the electrowinning of zinc and copper wherein opposite surfaces of laterally moving electrodes are cleaned in the area of solution lines with a first pair of stationary, opposed, rotating auxiliary brushes and immediately thereafter the opposite surfaces of stationary electrodes are cleaned below the solution line and between edge sticks with a second pair of vertically moving, opposed, rotating main brushes. The main brushes are pivotally mounted on a pair of vertically-reciprocal carriages having means to center an electrode therebetween.

10 Claims, 5 Drawing Figures

ELECTRODE BRUSHING APPARATUS

BACKGROUND OF THE INVENTION

This invention relates to the electrolytic recovery of metals and, more particularly, relates to a method and an apparatus for brushing electrodes used in the electro-winning of non-ferrous metals such as zinc and copper.

In the electrolytic recovery of non-ferrous metals, refined metal is usually deposited on a cathodic surface such as a base plate or starting sheet partly immersed in electrolyte to the electrolyte solution line. For example, in the electro-winning of zinc, refined zinc is deposited from a purified zinc sulfate solution on aluminum cathodes from which the high purity zinc is recovered by stripping. In the electrolytic recovery of copper, pure copper may be deposited on starting sheets made of stainless steel or titanium, from which the refined copper is recovered by stripping. The starting sheets or cathodes are then returned to the electrolytic cells for deposition of a new quantity of refined metal. In most cases, the cathodes are fitted along their vertical edges with electrically non-conductive edge strips to prevent metal deposition on the edges of the cathodes and to facilitate the stripping of deposits.

In the electrolytic processes, a certain amount of corrosion of the cathodes takes place which results in the formation of irregularities on the cathode surfaces, especially in the area around the solution line. Irregularities may also be caused by shorting occurring between electrodes. Such irregularities lead to inhomogeneous metal deposits or undesirably strong adhesion of the deposit to the cathode. To alleviate these problems, it has become conventional practice to periodically brush the cathode sheets. Such brushing can be done mechanically with wire brushes either manually or in an automated fashion.

PRIOR ART

The prior art reveals a number of patents related to the brushing of plates such as cathodes and anodes. U.S. Pat. No. 405,452, issued June 18, 1889, shows the use of brushes in a circular electrolytic cell. U.S. Pat. No 1,978,037, issued Oct. 23, 1934, shows a rotating cathode and a travelling brush of flexible rubber with embedded abrasive. U.S. Pat. No. 2,218,913, issued Oct. 22, 1940, discloses an apparatus for scrubbing and polishing metal strip including upper and lower scrubbing rolls jorunaled in fixed positions in a frame.

In U.S. Pat. No. 2,220,982, which issued Nov. 12, 1940, there is disclosed an apparatus for washing and brushing anodes including flexibly mounted rotary brushes, an elevator to lower the anodes between the brushes and means to raise the anodes. According to U.S. Pat. No. 2,439,305, issued Apr. 6, 1948, plates are moved between vertically disposed brushes which are adjustable toward and away from each other. U.S. Pat. No. 3,501,795, issued March 24, 1970 discloses a cleaning machine for anodes which comprises a first conveyor to move anodes to the machine, a second conveyor to lift anodes past a first brush and lower the anodes past a second brush, and high pressure water sprays to remove any further adhering material. It is stated that the brushes cover the width of the anodes and that edge sticks do not have to be removed.

According to U.S. Pat. No. 4,138,755, which issued Feb. 13, 1979, there is disclosed a polishing apparatus for cathode mother plates which comprises a conveyor for carrying stripped plates, a lift frame to grip the plates and lift them above the conveyor and a moveable head with four horizontal brushes superimposed in a vertical plane on each side of the lifted plate. The heads with brushes can be moved to and from the plate as well as up and down a limited vertical distance. Water sprays are applied during brushing.

According to U.S. Pat. No. 4,148,108, which issued April 10, 1979, cathodes having edge sticks, one having a pivotal upper portion, are transferred laterally from a conveyor to a brushing station. Aligned cathodes are pushed forward into an elevator frame and each cathode is moved up and down past wire brushes. Means are provided to lift up the pivotal portion of the edge stick prior to brushing and to push the pivotal portion back onto the cathode after brushing. The edge sticks are shielded during brushing with moveable protectors.

The apparatus for cleaning electrodes disclosed in the prior art have a number of disadvantages. The time needed for cleaning is generally long which, in some apparatus, is a result of moving electrodes sequentially into an elevator frame and moving the electrodes past substantially stationary brushes. A second disadvantage is the incomplete cleaning of the electrodes, especially at the upper portion in the area of the solution lines which includes the area of the pivotal upper portion of one of the edge sticks. Cleaning of these areas should receive special attention. Another drawback is the need to avoid brushing and damaging the edge sticks or protecting the edge sticks while cleaning the electrode surfaces. In many cases electrodes are clamped while brushed. In addition, in some of the apparatus, elaborate and complicated mechanical and hydraulic or pneumatic means are employed which result in high capital and maintenance costs.

STATEMENT OF INVENTION

It has been found that the disadvantages of prior art apparatus can be substantially eliminated by the method and apparatus of the present invention in which electrodes can be cleaned simply and effectively at the surface area between edge sticks and in the area of the solution line and the pivotal upper portion of the edge stick, without either removing or protecting the edge sticks. The cleaning time for each electrode, including feeding the electrodes to and from the brushing apparatus, is very short. Elevator means and transfer means for the electrodes between conveyors and elevator means are eliminated. The need for complicated mechanical, hydraulic or pneumatic means for cleaning are substantially obviated. The electrodes can be freely suspended and are self centering, eliminating clamping means as well as means for protecting edge sticks, Hereinafter, reference to the area of the solution line(s) is understood to include the area of the pivotal upper portion of the one edge stick.

More specifically, it has been found that by cleaning vertical electrodes, which are freely suspended from a laterally moving conveyor, at the area of the solution line with a first pair of stationary, rotating auxiliary brushes and immediately thereafter stopping the conveyor to clean the surfaces of the freely suspended electrodes below the solution line and between edge sticks with a second pair of vertically moving, rotating main brushes, the cleaning of electrode surfaces can be readily and effectively accomplished.

Accordingly, there is provided an apparatus for sequentially brushing electrodes each having opposite planar surfaces with solution lines thereon, a head bar including lifting lugs, vertical side edges having permanent edge sticks mounted on said side edges, and a bottom edge, which apparatus comprises: a frame for supporting first and second brushing mechanisms and having a passage extending therethrough, a conveyor for suspending and sequentially passing said electrodes through the passage in said frame in proximity to said brushing mechanisms; said first brushing mechanism comprising two pivotally mounted, vertically positioned, rotatable auxiliary brushes in opposing positions for brushing electrodes on the area of said opposite surfaces below and in proximity to the head bar, said area including the solution lines, means to rotate said auxiliary brushes; means to pivot said auxiliary brushes towards and away from electrodes such that when pivoted towards an electrode the rotating auxiliary brushes effect cleaning of both the solution line areas over the width of each electrode; a second brushing mechanism comprising two main brush carriages disposed in opposing positions on each side of said passage within said frame, means to index the suspended electrodes sequentially in a stationary position between said carriages, each carriage being mounted for vertical reciprocal travel in unison with the other, a pair of horizontal rotatable main brushes pivotally mounted on said brush carriages in opposing relationship and said main brushes being adapted to be pivoted towards and away from each other in said passage to engage and disengage opposite surfaces of an electrode in said passage; means to rotate said main brushes; means for vertically reciprocating said carriages, said brushes engaging the opposite surfaces of an electrode therebetween during said reciprocating to effect cleaning of the opposite surfaces of the electrode between the solution lines and bottom edge thereof; and means to de-index electrodes and pass electrodes on said conveyor from the brushing apparatus.

The main brushes and associated carriages are preferably vertically reciprocated between an upper position and a lower position whereby said main brushes can engage said electrode below said solution lines at the upper position by pivotal movement of the main brushes towards each other and whereby said main brushes can disengage said electrode at or in proximity to the bottom edge thereof at the lower position by pivotal movement of said main brushes away from each other for disengagement from the electrode therebetween and for return of said main brushes and respective carriages to the upper position reparatory to engagement of the brushes with the next electrode whereby each electrode is cleaned on both surfaces between said permanent edge sticks during vertical downward movement of said rotating main brushes on said carriages in unison with each other from said upper position to said lower position.

The means for vertically reciprocating the carriages comprise a pair of spaced-apart endless chains mounted for vertical reciprocal travel on each side of the passage, means for securing the carriages to the endless chains whereby the carriage move up and down in unison with each other, and drive means interconnected with said endless chains for driving said chains in synchronization.

It is a principal object of the present invention to provide a method and apparatus for quickly cleaning electrodes with a minimum of handling and conveying.

Another object of the invention is the provision of a method and apparatus which permits facile cleaning of electrodes by brushing without removal of or damage to edge sticks.

It is still another object of the invention to provide a method and apparatus for effectively cleaning electrodes across the top portion, including the solution lines, of the electrode faces. These and other objects of the invention and the manner in which they can be attained will become apparent from the following detailed description of the accompanying drawings, in which.

The method and apparatus of the present invention are particularly suitable for the cleaning of cathodes, and the following description is made with reference to cathodes.

Figure 4:
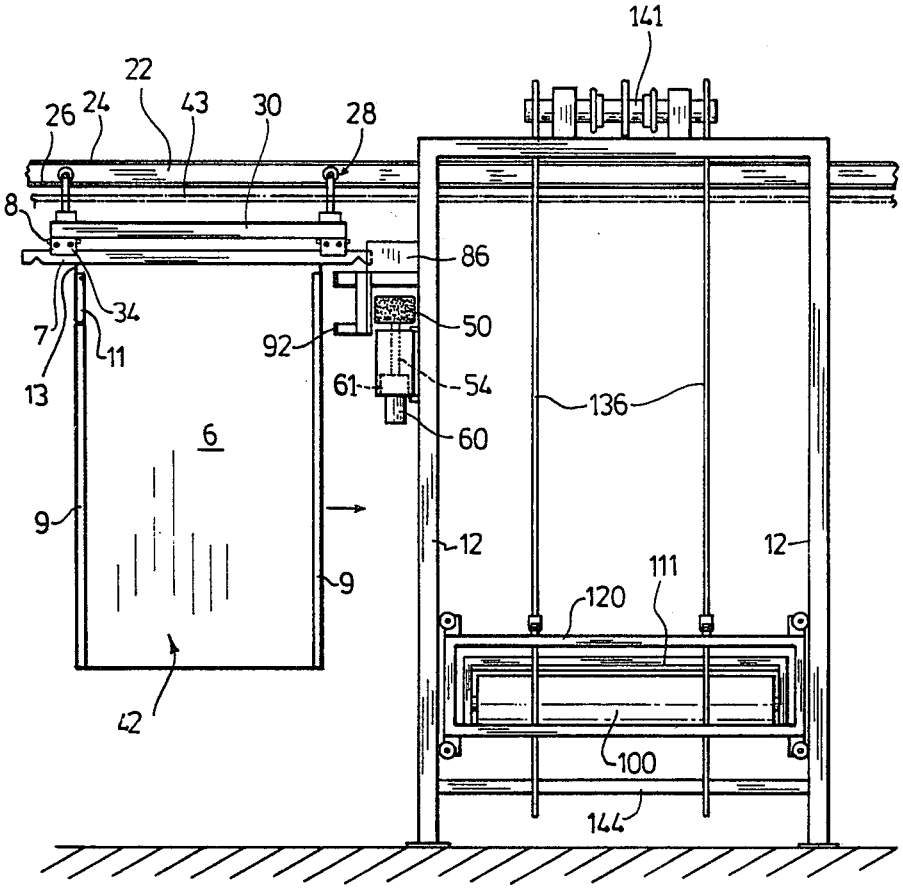
FIG. 4 is a side elevation of the apparatus of the invention showing an electrode preparatory to the electrode entering the apparatus.
Figure 5:
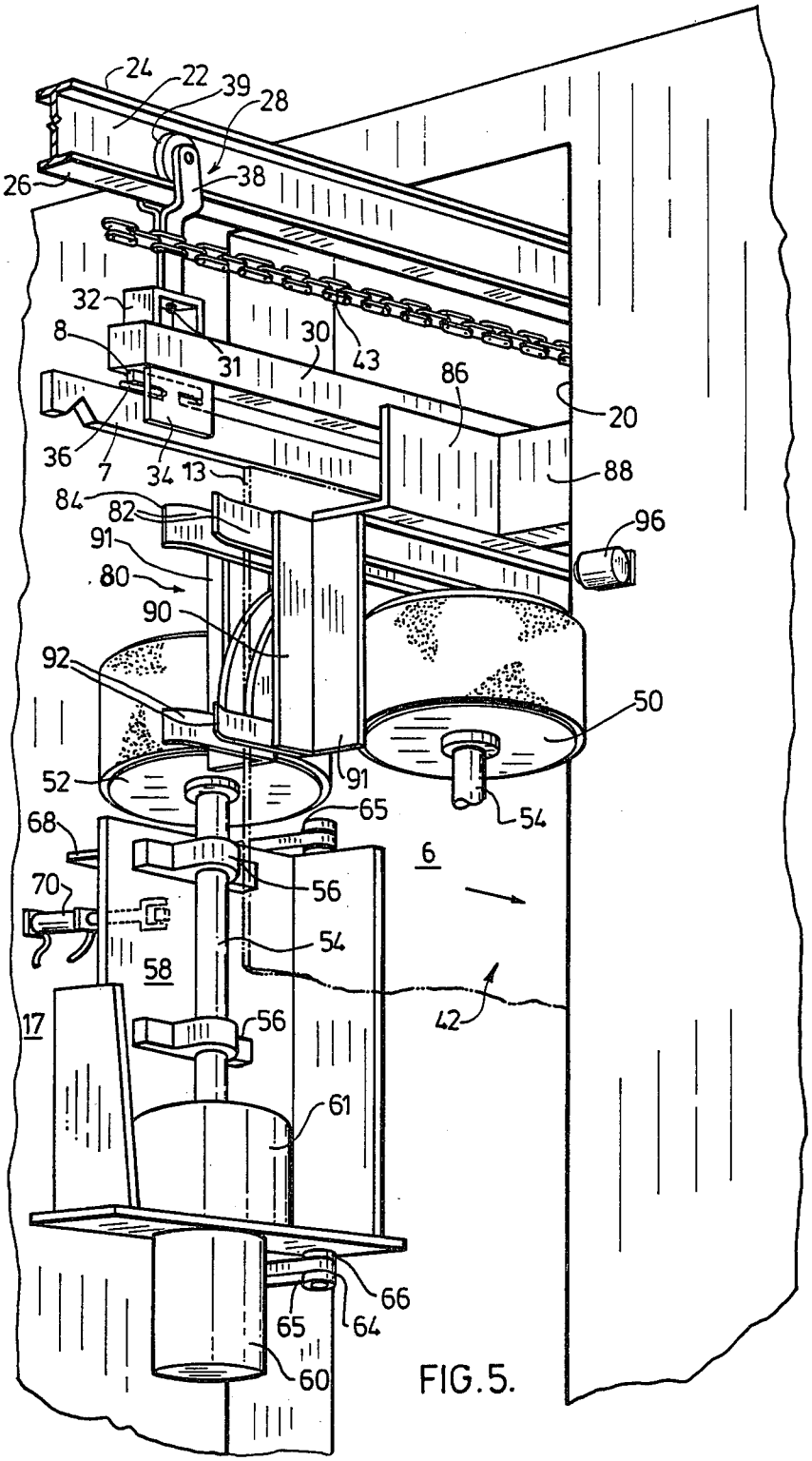
FIG. 5 is a perspective view of the auxiliary brushes at the entrance to the brushing apparatus showing a portion of an electrode therebetween in ghost lines.

With reference to FIGS. 4 and 5, cathodes generally indicated at 42 consist of an electrode sheet 6 supported from a head bar 7 provided with two spaced apart lifting lugs 8, which are preferably T-shaped. Permanent edge sticks 9 are mounted on the vertical edges of the electrode sheet. Preferably, the edge sticks are tapered down towards the centre of the electrode sheet and one of the edge sticks has a pivotally mounted upper portion or guard piece 11. When electrodes enter the brushing machine, the guard piece is pivoted from the electrode edge 13 into a horizontal position, in which it remains during passage of the electrode through the brushing machine. The guard piece 11 is normally pivoted back onto the electrode edge 13 when the electrode leaves the brushing machine.

With reference now to FIGS. 1–3 and 5 of the drawings, the apparatus of the invention comprises a frame generally designated by the numeral 10 having vertical corner posts 12 interconnected at their tops by side beams 14 and end beams 16. The frame components may be made of tubular steel welded together to form a rigid, self-supporting structure. A passage 18 most clearly shown in FIGS. 1 and 2 extending through frame 10 is defined by spaced-apart vertical posts 20 interconnected by lower horizontal members 21 and secured to upper end beams 16. With the exception of the areas between posts 20 which define passage 18, the sidewalls, end walls and top wall of frame 10 are preferably enclosed by steel plate 17 shown in FIG. 5.

A conveyor rail 22, shown more clearly in FIG. 1 and FIGS. 3–5, which rail is part of an electrode conveyor system, is in the form of an "I-beam" passing medially through passage 18 with the upper flange 24 secured to the underside of end beams 16. Lower flange 26 is adapted to support a plurality of trolleys 28 connected to the opposite ends of support bars 30 by stub shafts 31 pivotally mounted in hanger brackets 32. Each of downwardly depending plates 34 at the ends of support bars 30 has a pair of slightly upwardly inclined lateral pins 36 extending therefrom adapted to engage and support the T-shaped lifting lugs 8 on each head bar 7 of an electrode 42 for support of the electrode 42 below the conveyor rail 22. Each trolley 28 has a pair of laterally-spaced wheels 39 journalled in fork 38 adapted to roll along flange 26 for conveyance of the trolleys under conveyor rail 22 by endless chain 43 connected thereto. Successive electrodes 42 thus can be sequentially conveyed through passage 18 of the brushing apparatus.

A first brushing mechanism comprises a pair of opposed wire auxiliary brushes 50, 52, one of which is shown in detail in FIG. 5. The auxiliary brushes 50,52 are stationed at the entrance to passage 18 and are vertically positioned a spaced distance apart on shafts 54 journalled in brushings 56 mounted on support plates 58. An electric or hydraulic motor 60 with a gear reducer and coupling 61 drives each of brushes 50, 52 in a direction of rotation opposite to the direction of travel of electrodes 42 through the cleaning apparatus. Brush 52 thus would rotate in a clockwise direction and brush 50 in a counteclockwise direction as viewed in FIG. 5.

Each support plate 58 is pivotally mounted on a vertical support rod 64 journalled in bushings 65 secured to a post 20 by support sleeves 66 which are secured to the rear side of support plate 58 and to flange 68. A hydraulic piston-cylinderassembly 70 is secured at one end to exterior end wall 17 and at the other end to the rear side of support plate 58, as shown in FIG. 5, for pivoting auxiliary brushes 50, 52 away from and towards each other for the cleaning of electrodes 42 therebetween in the area of the solution lines, not shown, and the guard piece 11.

A guide mechanism depicted by numeral 80 in FIGS. 1 and 5 comprises a pair of spaced-apart horizontal guide rails 82 extending medially through passage 18 below support rail 22. Guide rails 82 are supported by angle members 86 which in turn are supported by lateralmembers 88 secured to posts 20. Converging leading edges 84 of rails 82 and lower spaced-apart converging guides 92 supported below rails 82 by downwardly depending angles 90 assist guided entry of electrodes 42 between spaced apart brushes 50, 52. Angles 90 have outwardly extending flanges 91 opposite brushes 50, 52.

In operation of the first brushing mechanism, a control system, not shown, is actuated by photo-electric cell 96 which senses the entrance of the leading edge of electrode 42 between auxiliary brushes 50, 52 such that piston-cylinder assemblies 70 are actuated to extend pivotally-mounted support plates 58 carrying the brushes towards each other such that the brushes will frictionally engage the opposed surfaces of the electrode therebetween below the head bar in an area which includes the solution lines. Concurrent with the actuation of piston-cylinder assemblies 70, motors 60 are energized to rotate brushes 50, 52 at a desired speed such that said brushes rotate in frictional engagement with the surfaces of the electrode during passage of the electrode therebetween. Passage of the trailing edge of electrode 42 past photoelectric cell 96 causes piston-cylinder assembly 70 to retract the brush assemblies away from each other and to de-energize motors 60.

Figure 1:
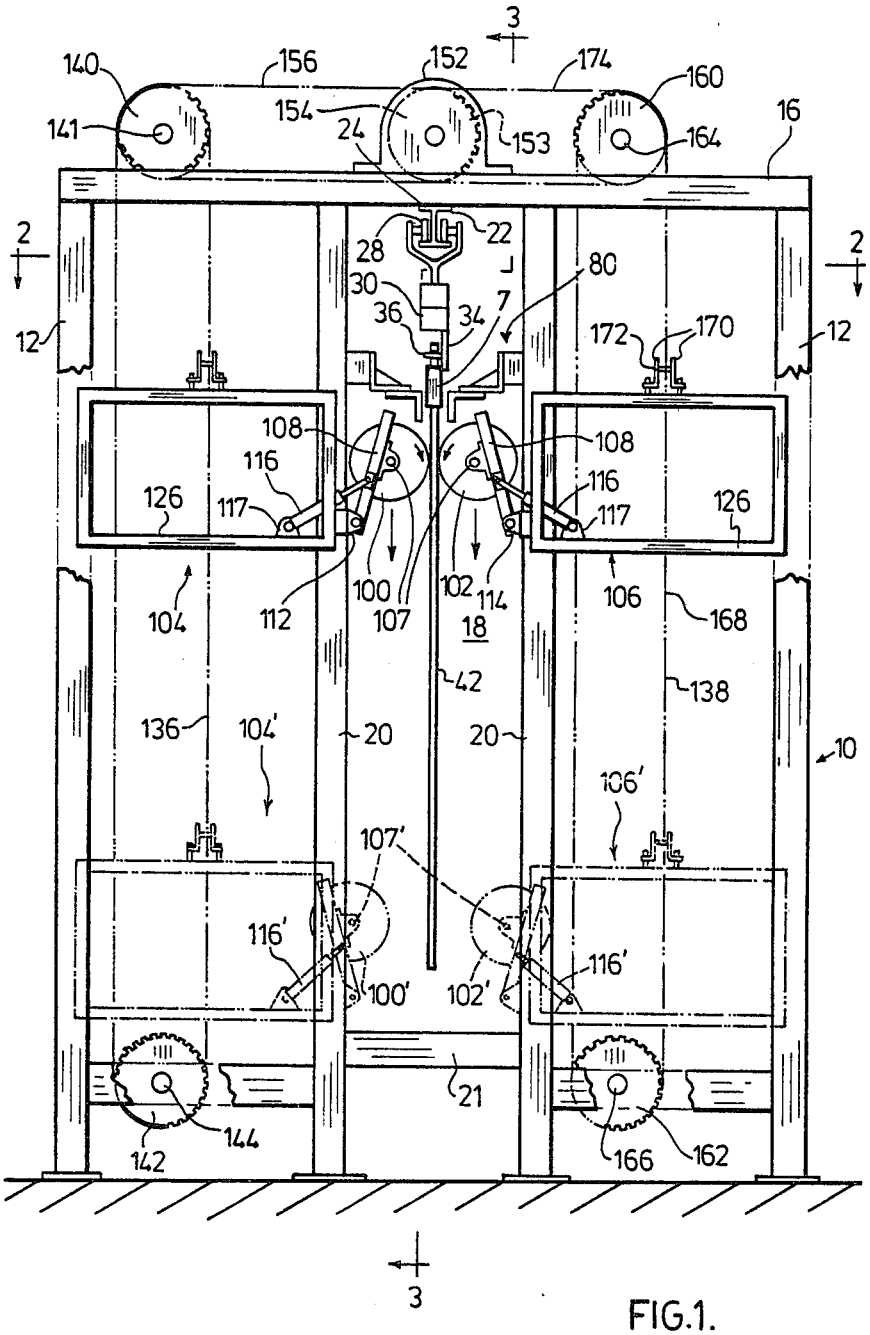
FIG. 1 is an end elevation of the apparatus of the invention, partly cut away, showing an electrode at the initiation of the main brushing stage.
Figure 2:
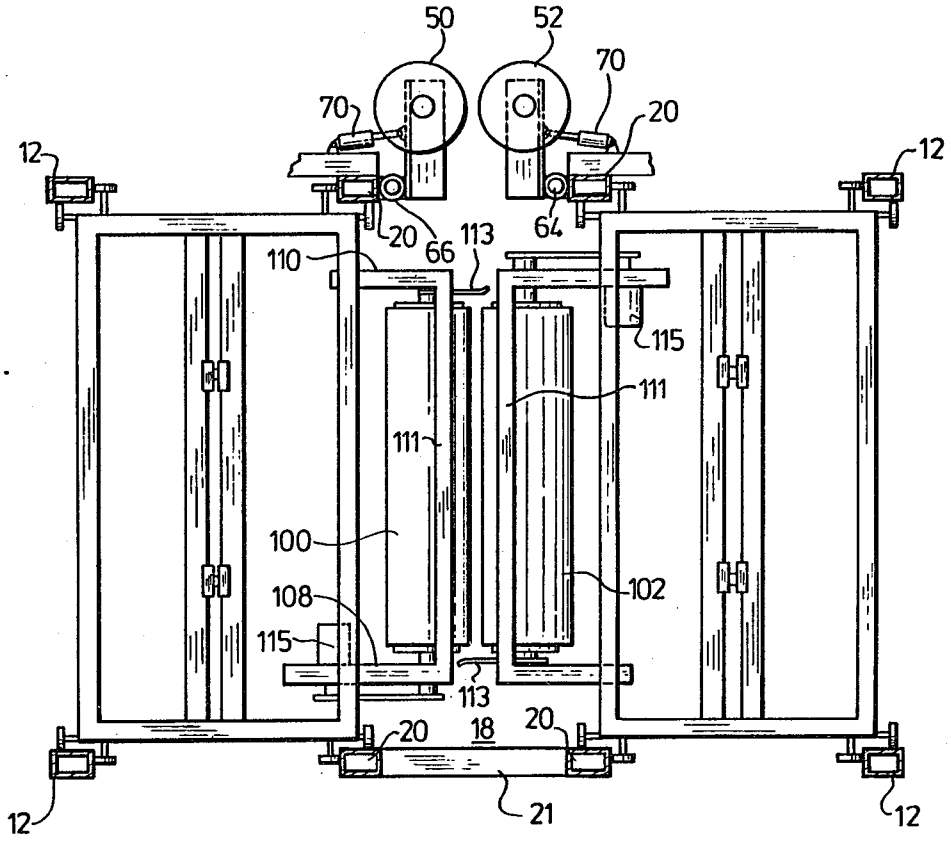
FIG. 2 is a plan section of the apparatus taken along the line 2–2 of FIG. 1 showing the main brushes in their extended operative positions.
Figure 3:
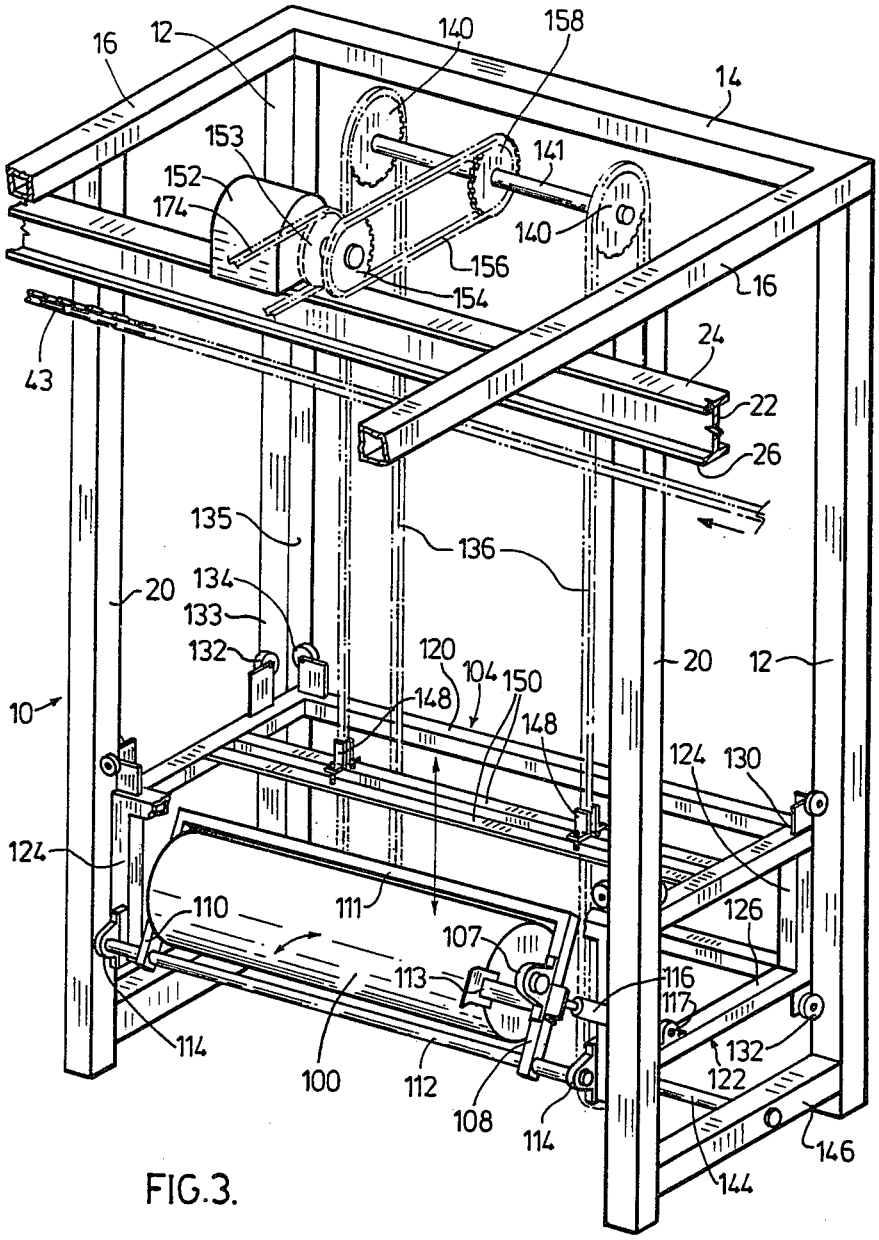
FIG. 3 is a perspective view of a main brush mechanism in its lowered retracted position taken along line 3–3 of FIG. 1.

With reference now to FIGS 1, 2 and 3, a second brushing mechanism comprises main brushes 100,102, which are rotatably mounted and supported in carriages 104, 106, one of which will be described, by bushings frame 111 (FIGS. 2 and 3) having side arms 108,110, which are pivotally mounted on shaft 112 which in turn is journalled in bushings 114.

Lateral guide arms 113 extend beyond the periphery of main brushes 100, 102, one from each brushing mechanism on opposite side arms 108, 110 of frames 111 and serve to position the electrode such that the brushes are centered between the edge sticks 9. Each of the main brushes 100,102 is rotated by an electric or the like drive mechanism 115 (FIG. 2).

A piston-cylinder assembly 116 pivotally connected at one end to side arm 108 and connected at the other end to carriage 104, (106) extends and retracts brushes 100, 102 towards and away from each other as depicted by the solid and ghost lines in FIG. 1, to be described.

Carriages 104, 106 each comprises a rectangular upper frame 120 and a rectangular lower frame 122 of welded tubular steel joined by vertical corner posts 124. Bushings 114 are secured to corner post 124 and one end of each of piston-cylinder assemblies 116 is hingeably secured via bushing 117 to a side strut 126 of lower frame 122. Each corner 130 of upper and lower rectangular frame 120, 122 has a pair of guide rolls 132, 134 journalled thereon perpendicular to each other to contact in rolling engagement the opposing corner faces 133, 135 of post 12 or 20 of frame 10 for centering of carriages 104, 106 for vertical reciprocal travel. Carriages 104, 106 are raised and lowered by pairs of endless chains 136, 138 respectively. Carriage 104, for example, is shown to have a pair of vertically-extending spaced-apart chains 136 passing over upper sprocket wheels 140 mounted on shaft 141 journalled in bushings mounted on upper beams, not shown, and around lower sprocket wheels 142 mounted on shaft 144 journalled in side beams 146. Chains 136 are secured to the centre of carriage 104 by clamps 148 fastened to centering angles 150 forming part of upper frame 120.

Drive motor 152 has two sprocket wheels 153, 154. Sprocket wheel 154 is interconnected with shaft 141 by endless chain 156 passing over sprocket wheel 158 mounted on shaft 141, whereby activation of motor 152, for clockwise or counterclockwise rotation as viewed in FIG. 3, will raise or lower carriage 104 with brush 100 pivotally mounted thereon.

Carriage 106 is in like manner raised and lowered by endless chains 138 (FIG. 1) passing over a pair of upper sprocket wheels 160 and about a pair of lowersprocket wheels 162 mounted for rotation on shafts 164, 166, respectively, in the manner described for carriage 104. Sprocket wheels 160, 162 are mounted close to passage 18 such that the vertical component 168 of chains 138 are positioned medially in the compartment in which carriage 106 is located and are secured to centering angles 170 by means of clamps 172. Sprocket wheel 160 is interconnected with drive sprocket wheel 153 by endless chain 174 which passes over sprocket wheels 153 and 160.

In operation, electrodes 42 sequentially entering passage 18 are each in turn indexed by a photoelectric cell or limit switch, not shown, to a stationary position between retracted brushes 100, 102 on carriages 104, 106 in their upper position. As soon as the electrode is indexed, piston-cylinder assemblies 116 are actuated to pivotally extend support frames 111 and the brushes journalled thereon towards each other into frictional engagement with the electrode 42 therebetween as indicated by solid lines in FIG. 1 such that the side edges of the electrode are straddled by laterl guide arms 113 extending from side arms 108, 110 frames 111.

Electrodes are freely suspended from the conveyor at all times. The lateral pins 36 which support each electrode are loosely linked to the wheels 39 which run on conveyor rail 22. The loose linking allows some limited pendulum movement of the electrode in the direction of the conveyor when wheels 39 are in stationary position above the brushes 100, 102. When the brushes are brought to bear on the electrode surfaces, only the aluminum of the cathode must be touched. If the brushes were to infringe on the edge sticks, serious damage would occur. The lateral guide arms 113 centre the electrode to within a certain desired tolerance with centering permitted by the loose linking. A small clearance, of for example 5 mm, is allowed between the edge sticks and the ends of the brushes. The use of tapered edge sticks further enhances the self-centering feature. The taper lessens the thickness of the edge sticks towards the centre-line of the electrode. If one end of the brushes were to infringe on the edge sticks, the taper forces the electrode, which is allowed to move laterally, to move away from the infringing end of the brushes. The free suspension of the electrode, the guide arms and the tapered edge sticks ensure that the brushes only scour the electrode faces.

Brushes 100, 102 are rotated at the same speed by the electric or the like drive mechanism 115 in opposite directions as indicated by the arrows. Drive motor 152 is energized concurrently with the actuation of piston-cylinder assemblies 116 to rotate drive sprocket wheels 153, 154 and driven sprocket wheels 140,160 in the same direction of rotation such that chains 136, 138 will lower carriages 104, 106 in unison from the upper position indicated to the lower position indicated by ghost lines showing the brushes depicted by numerals 100', 102' in their retracted positions. Rotating brushes 100, 102 thus effectively clean the opposite surfaces of electrode 42 by scouring of said surfaces in a downward direction as the brushes descend to the lowermost position just beyond the bottom edge of the electrode. As soon as the brushes reach their lowermost position, a limit switch or photoelectric cell, not shown, automatically withdraws the brushes by retraction of piston-cylinder assembly to the position depicted by numerals 116' preparatory to elevation of carriages 104', 106' to the uppermost position awaiting introduction of the next electrode to be cleaned by the main brushes. Upon retraction of brushes 100', 102', the electrode is de-indexed and is moved by conveyor 43 from passage 18, while carriages 104, 106 are elevated.

Concurrent with the elevation of carriages 104, 106 to the upper position, the conveyor system passes electrode 42 out of the brushing apparatus while the auxiliary brushes 50, 52 clean the areas including the solution lines of the next incoming electrode.

Using the apparatus and method described herein, cathodes from a process for the elextrowinning of zinc were effectively cleaned. The surface area of one face of a cathode was 1.5m$^2$. The auxiliary brushes were steel bristle brushes with a diameter of 25 cm and a length of 10 cm, and were rotated at 400 rpm. The main brushes were steel bristle brushes with a diameter of 25 cm and a length of 99 cm, and were rotated at 400 rpm. The clearances between the cathode edge sticks and the ends of the main brushes were 5 mm. The downward rate of movement of the main brushes and carriages was 40 cm/sec and the upward rate was cm/sec. The time elapsed between a cathode entering and leaving the brushing machine, i.e. the time between successive de-indexings, was 8 seconds. The actual brushing time was 5 seconds.

It will be understood that modifications can be made in the embodiment of the invention illustrated and described herein without departing from the scope and purview of the invention as defined by the appended claims.

What I claim as new and desire to protect by Letters Patent of the United States is:

1. An apparatus for sequentially brushing electrodes, said electrode each having opposite planar surfaces with areas having solution lines thereon, a head bar including lifting lugs, vertical side edges having permanent edge sticks mounted on said side edges, and a bottom edge, which apparatus comprises: a frame for supporting first and second brushing mechanisms and having a passage extending therethrough a conveyor for suspending and sequentially passing said electrodes through the passage in said frame in proximity to said brushing mechanisms; said first brushing mechanism comprising two pivotally mounted, vertically positioned, rotatable auxiliary brushes in opposing positions for brushing electrodes on the areas of said opposite surfaces below and in proximity to the head bar, said areas including the solution lines; means to rotate said auxiliary brushes; means to pivot said auxiliary brushes towards and away from electrodes such that when pivoted towards an electrode the rotating auxiliary brushes effect cleaning of both the solution line areas over the width of each electrode; a second brushing mechanism comprising two main brush carriages disposed in opposing positions on each side of said passage within said frame, means to index the suspended electrodes sequentially in a stationary position between said carriages, each carriage being mounted for vertical reciprocal travel in unison with the other, a pair of horizontal rotatable main brushes pivotally mounted on said brush carriages in opposing relationship and said main brushes being adapted to be pivoted towards and away from each other in said passage to engage and disengage opposite surfaces of an electrode in said passage; means to rotate said main brushes; means for vertically reciprocating said carriages, said brushes engaging the opposite surfaces of an electrode therebetween during said reciprocating to effect cleaning of the opposite surfaces of the electrode between the solution lines and bottom edge thereof; and means to de-index electrodes and pass electrodes on said conveyor from the brushing apparatus.

2. An apparatus as claimed in claim 1 wherein the brush carriages are vertically reciprocated between an upper position and a lower position whereby said main brushes can engage said electrode below said solution line at the upper position by pivotal movement of the main brushes towards each other and whereby said main brushes can disengage said electrode at or in proximity to the bottom edge thereof at the lower position by pivotal movement of said main brushes away from each other for disengagement from the electrode therebetween and for return of said main brushes and respective carriages to the upper position preparatory to engagement of the brushes with the next electrode whereby each electrode is cleaned on both surfaces between said permanent edge sticks during vertical downward movement of said rotating main brushes on said carriages in unison with each other from said upper position to said lower position.

3. An apparatus as claimed in claim 2 wherein said means for vertically reciprocating the carriages comprise a pair of spaced-apart endless chains mounted for vertical reciprocal travel on each side of the passage, means for securing the carriages to the endless chains whereby the carriages move up and down in unison with each other, and drive means inter-connected with said endless chain for driving said chains in synchronization.

4. An apparatus as claimed in claim 3 wherein each said electrode has a guard piece pivotally mounted on one edge thereof adjacent the head bar, said guard piece forming the upper portion of one of said permanent edge sticks, and means provided external of the supporting frame for pivoting the guard piece away from the electrode prior to contact of the electrode by the auxiliary brushes and for pivoting said guard piece back unto said electrode when or after the electrode leaves the apparatus.

5. An apparatus as claimed in claim 4 wherein means are provided for centering each electrode between the main brushes, said centering means including means for loosely suspending the electrode fromthe conveyor whereby the electrode has limited pendulum movement in the dirction of the conveyor and a lateral guide arm extending from opposite ends of the oposed main brushes to engage the side edges of the electrode for centering the electrode therebetween.

6. An apparatus as claimed in claim 5 wherein means are provided for centering each electrode between the main brushes, said centering means including, in combination, a pair of T-shaped lifting lugs attached to the head bar of the electrode, equispaced support means depending from the conveyor each having a pair of slightly upwardly inclined lateral pinsextending therefrom adapted to engage a T-shaped lifting lug, and a lateral guide arm extending from opposite ends of the opposed main brushes to engage the side edges of the electrode for centering the electrode therebetween.

7. An apparatus as claimed in claim 3 wherein means are provided for centering each electrode between the main brushes, said centering means including means for loosely suspending the electrode form the conveyor whereby the electrode has limited pendulum movement in the direction of the conveyor and a lateral guide are extending from opposite ends of the opposed main brushes to engage the side edges of the electrode for centering the electrode therebetween.

8. An apparatus as claimed in claim 2 wherein each said electrode has a guard piece pivotally mounted on one edge thereof adjacent the head bar, said guard piece forming the upper portion of one of said permanent edge sticks, and means provided external of the supporting frame for pivoting the guard piece away from the electrode prior to contact of the electrode by the auxiliary brushes and for pivoting said guard piece back unto said electrode when or after the electrode leaves the apparatus.

9. An apparatus as claimed in claim 8 wherein means are provided for centering each electrode between the main brushes, said centering means including, in combination, a pair of T-shaped lifting lugs attached to the head bar of the electrode, equispaced support means depending from the conveyor each having a pair of slightly upwardly inclined lateral pins extending therefrom adapted to engage a T-shaped lifting lug, and a lateral guide arm extending from opposite ends of the opposed main brushes to engage the side edges of the electrode for centering the electrode therebetween.

10. An apparatus as claimed in claim 2 wherein means are provided for centering each electrode between the main bushes.

* * * * *